United States Patent [19]

Matsuo et al.

[11] Patent Number: 4,736,082

[45] Date of Patent: Apr. 5, 1988

[54] ELECTROMAGNETIC INDUCTION HEATING APPARATUS CAPABLE OF PREVENTING UNDESIRABLE STATES OF COOKING UTENSILS OR VESSELS

[75] Inventors: Katsuharu Matsuo, Aichi; Teruya Tanaka, Yokkaichi, both of Japan

[73] Assignee: Kabushiki Kaisha Toshiba, Kawasaki, Japan

[21] Appl. No.: 35,344

[22] Filed: Apr. 7, 1987

[51] Int. Cl.[4] ..... H05B 6/06

[52] U.S. Cl. ..... 219/10.77; 219/10.49 R

[58] Field of Search ..... 219/10.49 R, 10.77, 219/10.75, 10.67; 99/DIG. 14, 325, 451

[56] References Cited

U.S. PATENT DOCUMENTS

| | | | |
|---|---|---|---|
| 3,906,181 | 9/1975 | Hibino et al. | 219/10.49 R |
| 3,993,885 | 11/1976 | Kominami et al. | 219/10.75 X |
| 4,010,342 | 3/1977 | Austin | 219/10.77 X |

FOREIGN PATENT DOCUMENTS

| | | |
|---|---|---|
| 54-43344 | 4/1979 | Japan . |
| 54-43345 | 4/1979 | Japan . |

*Primary Examiner*—Philip H. Leung

*Attorney, Agent, or Firm*—Oblon, Fisher, Spivak, McClelland & Maier

[57] ABSTRACT

An object to be heated, such as a cooking utensil or vessel, is placed on a top plate. An inventer has a resonating circuit comprising an induction heating coil arranged below the top plate and a resonating capacitor connected to the coil, and a circuit for supplying high-frequency power to the resonating circuit in order to generate a high-frequency magnetic field from the induction heating coil and to induce an eddy current in the object to be heated. An inverter power level control data generating unit outputs inverter power level control data according to the relationship between the high-frequency power from the inverter circuit and a repulsion force acting on the object to be heated, based on the high-frequency power. The inverter power level control data is data for controlling the level of the high-frequency power from the inverter circuit so as to prevent the object to be heated from floating over a placing surface of the top plate, due to the repulsion force. A control unit feeds back the inverter power level control data from the control data generating unit to the inverter circuit.

9 Claims, 9 Drawing Sheets

ELECTROMAGNETIC INDUCTION HEATING APPARATUS CAPABLE OF PREVENTING UNDESIRABLE STATES OF COOKING UTENSILS OR VESSELS

BACKGROUND OF THE INVENTION

This invention relates to an electromagnetic induction heating apparatus which can prevent undesirable states of cooking utensils or vessels and, more particularly, to an apparatus for heating an object to be heated such as a cooking vessel based on an eddy current loss caused by electromagnetic induction.

In a conventional induction heating apparatus, an induction heating coil is arranged below a top plate on which an object to be heated such as a cooking vessel is placed. A high-frequency current is supplied to the induction heating coil by an inverter, so that a high-frequency magnetic field is applied to the cooking vessel to flow an eddy current therethrough, thereby heating it.

In the induction heating apparatus of this type, since a current flowing through the induction heating coil has an opposite phase to the eddy current flowing through the cooking vessel, the cooking vessel receives a repulsion effect. If the cooking vessel is made of a magnetic material such as iron, the cooking vessel is attracted by the magnetic force caused by the magnetic field from the coil, and as a result, a repulsion force acting on the cooking vessel is reduced.

However, if the cooking vessel is formed of a non-magnetic material such as aluminum (Al), an attractive force due to the magnetic force is small. Since an Al cooking vessel has a small specific permeability and surface resistance, a large eddy current must be flowed through the Al vessel in order to make the input resistance with respect to the induction heating coil equivalent to that of an iron cooking vessel. Therefore, a repulsion force acting on the Al cooking vessel undesirably increases. As a result, if a total weight of the Al vessel and a material to be heated stored therein is small, the vessel often floats above the top plate. If this state is left unchanged, the heating efficiency is considerably reduced, and sufficient induction heating cannot be performed. In the worst case, the vessel is moved along the top plate.

FIG. 5 shows the relationship between a power [W] of the inverter and a repulsion force [g] acting on the vessel. In this case, the vessel is formed of Al, the number of turns of the induction heating coil is 80 turns, the frequency is 50 KHz, and a distance between the vessel and the heating coil is 6 mm. As can be seen from FIG. 5, the repulsion force is increased in proportion to the power of the inverter. More specifically, as the output increases, the vessel tends to float from the top plate.

In order to solve the above problem, a detection mechanism is necessary to detect whether or not the vessel is floating from the top plate. For example, in a detection technique, a detection element for detecting a change in magnetic flux density, such as a Hall element or a search coil, can be used. In this case, a change in magnetic flux density cannot often be detected, depending on the location of the detection element, resulting in poor detection reliability. In this technique, since a magnetic flux density to be detected changes in accordance with the power of the inverter, a detection circuit arrangement becomes complex.

SUMMARY OF THE INVENTION

It is, therefore, an object of the present invention to provide a new and improved electromagnetic induction heating apparatus capable of preventing undesirable states of cooking utensils or vessels, such that if the total weight of an object to be heated and a material to be cooked therein is small and the object floats from the top plate due to the repulsion force from an induction heating coil, this can be reliably and relatively easily prevented.

According to the present invention, there is provided an electromagnetic induction heating apparatus capable of preventing undesirable states of cooking utensils or vessels, the apparatus comprising:

a top plate for placing an object to be heated such as a cooking utensil or vessel thereon;

inverter means having a resonating circuit comprising an induction heating coil arranged below the top plate and a resonating capacitor connected to the coil, and an inverter circuit for supplying high-frequency power to the resonating circuit in order to generate a high-frequency magnetic field from the induction heating coil and to induce an eddy current in the object to be heated;

inverter power level control data generating means for outputting inverter power level control data according to the relationship between the high-frequency power from the inverter circuit and a repulsion force acting on the object to be heated based on the high-frequency power, the inverter power level control data being data for controlling the level of the high-frequency power from the inverter circuit so as to prevent the object to be heated from floating above a placing surface of the top plate due to the repulsion force; and control means for feeding back the inverter power level control data from the control data generating means to the inverter circuit.

BRIEF DESCRIPTION OF THE DRAWINGS

These and other objects and features of the present invention can be understood through the following embodiments by reference to the accompanying drawings, in which:

FIG. 1 to FIGS. 3A through 3D show a first embodiment of the present invention, in which FIG. 1 is a general block diagram, FIG. 2 is a block diagram of the main part, and FIGS. 3A to 3D are graphs for explaining changes in power source voltage and changes in frequency;

FIG. 6 to FIGS. 8A through 8D show a third embodiment of the present invention, in which FIG. 6 is a general block diagram, FIG. 7 is a block diagram of the main part, and FIGS. 8A to 8D are graphs for explaining changes in power source voltage and changes in frequency.

DETAILED DESCRIPTION OF THE PREFERRED EMBODIMENTS

Figure 1:
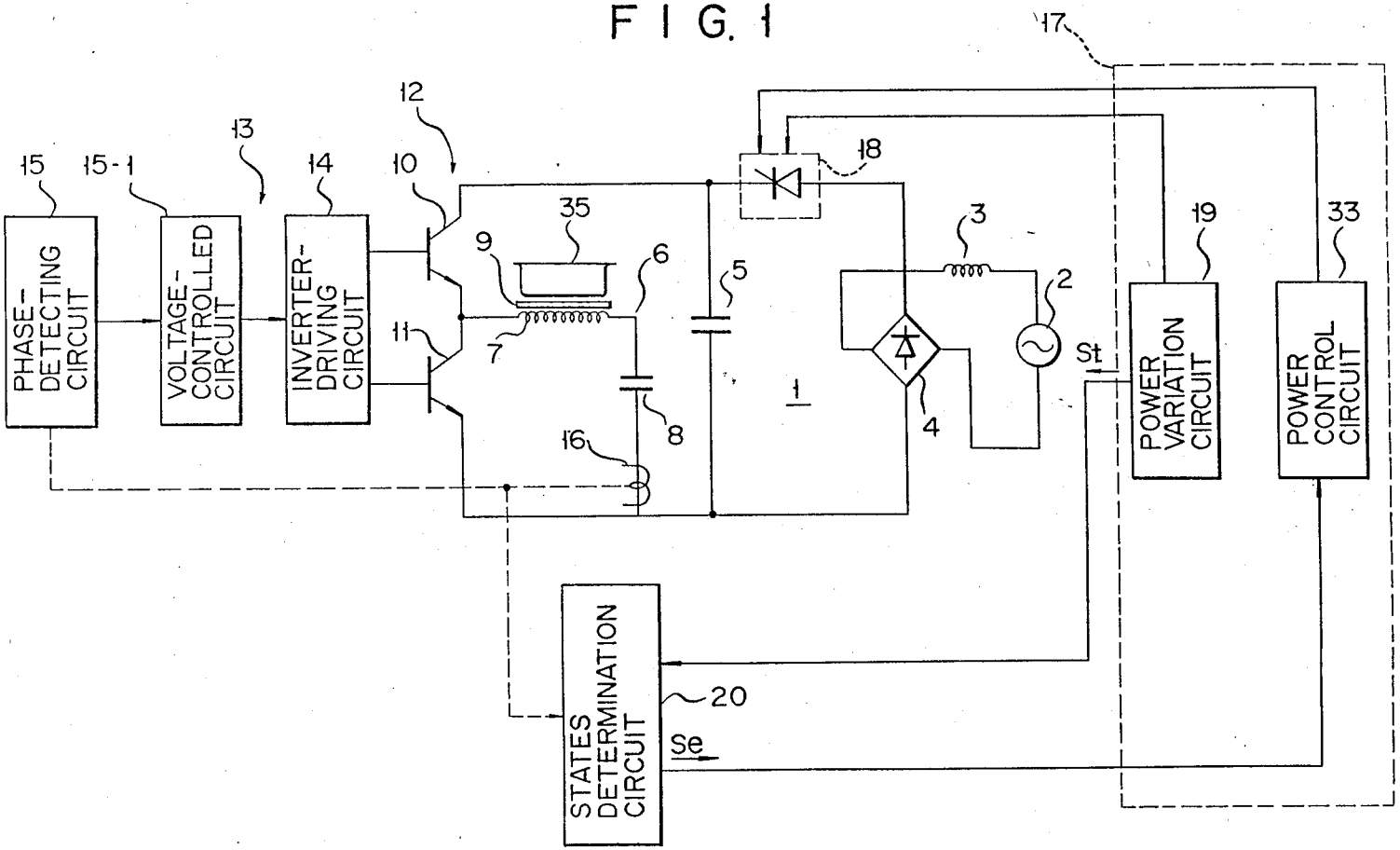
Figure 2:
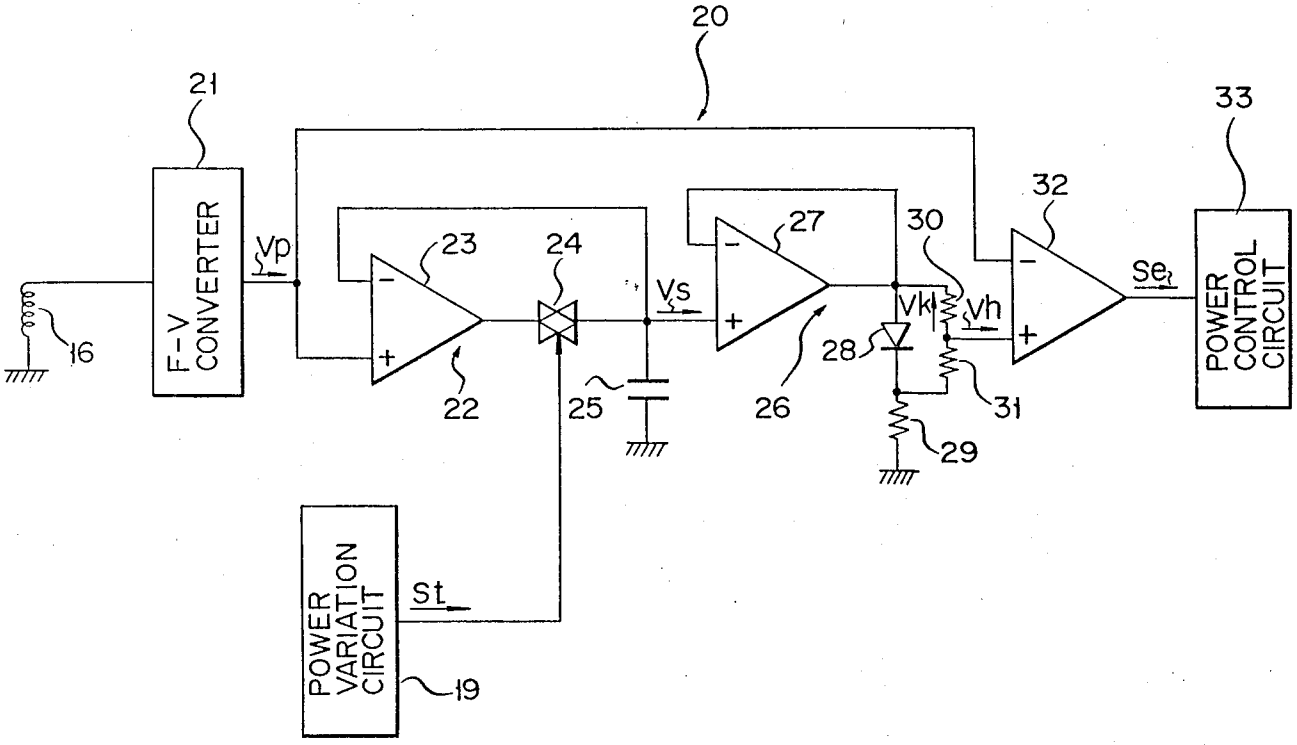
Figure 5:
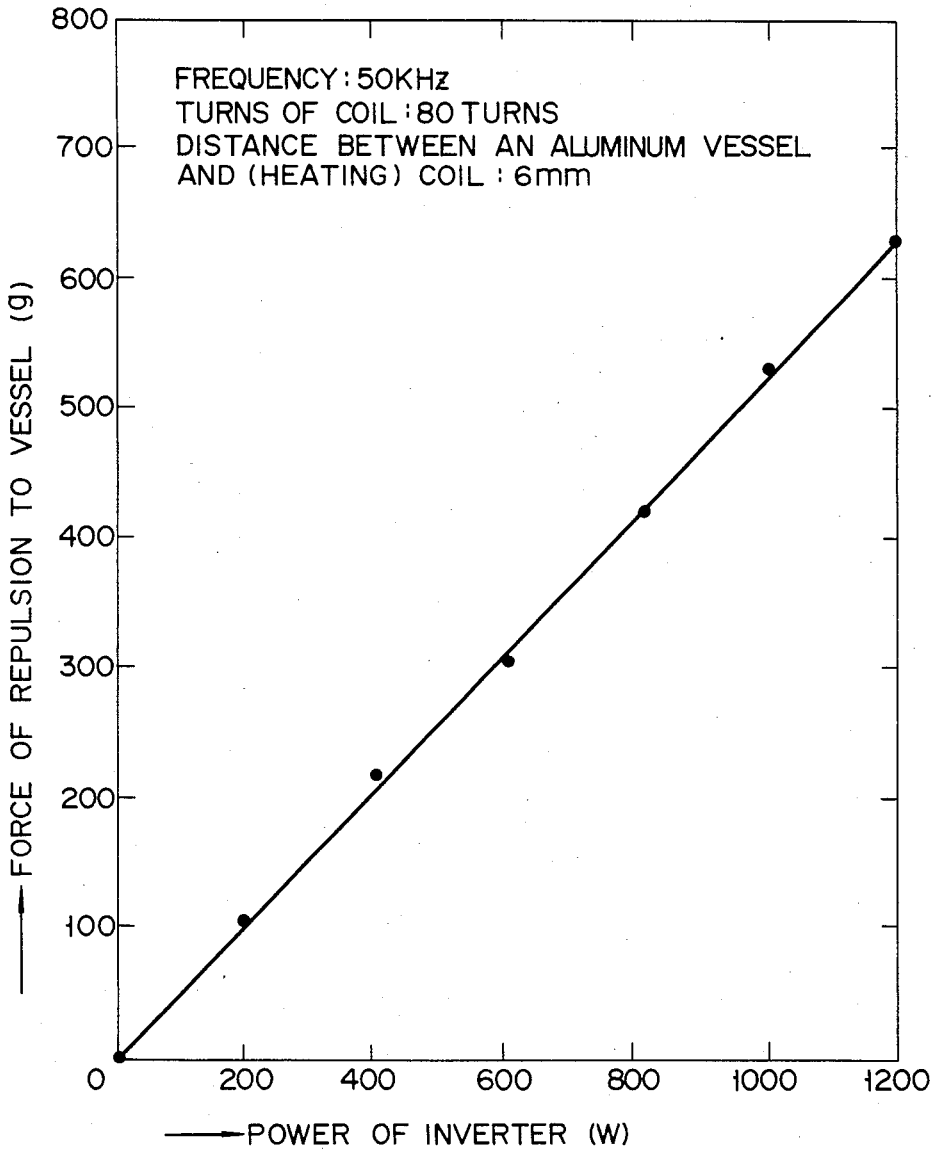
FIG. 5 is a graph showing the relationship between a power of an inverter and a repulsion force acting on an object to be heated.

A first embodiment of the present invention will now be described with reference to FIGS. 1 to 3. Referring to FIG. 1, reference numeral 1 denotes a DC power source. Power source 1 is constituted by connecting choke coil 3, full-wave rectifier 4, and smoothing capacitor 5 to AC power source 2. Reference numeral 6 denotes a resonating circuit consisting of induction coil 7 for heating an object to be heated, and resonating capacitor 8. Induction coil 7 is arranged below the lower surface of top plate 9, which is for placing the object to be heated thereon. Reference numerals 10 and 11 denote first and second switching transistors. Transistors 10 and 11 are connected to resonating circuit 6, as shown in FIG. 1, to constitute inverter 12. Reference numeral 13 denotes an inverter controller. Controller 13 has inverter driving circuit 14, phase detecting circuit 15, and voltage-controlled oscillator (VCO) 15-1. Inverter driving circuit 14 alternately turns on/off switching transistors 10 and 11. Phase detecting circuit 15 receives an output from instrument transformer 16 in resonating circuit 6, so as to feedback control inverter driving circuit 14 through VCO 15-1. More specifically, inverter driving circuit 14 controls the ON/OFF timing of transistors 10 and 11 based on an oscillation output from VCO 15-1 in accordance with the phase comparison output, thereby controlling an output frequency of inverter 12. As a result, resonating circuit 6 is controlled to maintain a frequency (resonating frequency) at which a resonating state is set for the object to be heated. Reference numeral 19 denotes a power variation circuit for varying a power of inverter 12 for a predetermined period, as will be described later, in order to produce inverter power level control data in accordance with the relationship between the inverter power and the repulsion force for a cooking vessel, as shown in FIG. 5. An output from power variation circuit 19 is connected to the gate electrode of switching thyristor 18. The main electrodes of switching thyristor 18 are connected to DC power source 1, as shown in FIG. 1. Power variation circuit 19 phase-controls the gate of thyristor 18 during a given period upon power-on, so as to change an output voltage from DC power source 1, thereby changing the power of inverter 12 from low power to high power for a predetermined period of time. Power variation circuit 19 outputs HIGH-level sampling timing signal St to states determination circuit 20 when it sets the power of inverter 12 at low power. Determination circuit 20 detects resonating frequency f of resonating circuit 6 through transformer 16 in order to produce the inverter power level control data, and outputs error detection signal Se based on the detection result. FIG. 2 shows states determination circuit 20 in detail. Reference numeral 21 denotes an F-V converter for detecting resonating frequency f of resonating circuit 6 in accordance with the output from transformer 16 and converting the detected frequency into a voltage. F-V converter 21 supplies detection voltage Vp corresponding to the detected frequency to the noninverting input terminal (+) of operational amplifier 23, and also supplies it to the inverting terminal (−) of comparator 32 (to be described later). Sample-hold circuit 22 has operational amplifier 23, analog switch 24, and memory capacitor 25. The gate terminal of analog switch 24 receives HIGH-level sampling timing signal St from power variation circuit 19 when circuit 19 is in the low-power control mode. Memory capacitor 25 samples and holds output voltage Vp component corresponding to resonating frequency f, i.e., initial frequency f0, of resonating circuit 6 as sample-hold voltage Vs when circuit 19 is in the low-power control mode. Reference numeral 26 denotes a reference value setting circuit, which comprises operational amplifier 27, diode 28, and resistors 29, 30, and 31. Reference value setting circuit 26 outputs initial setting voltage Vh obtained by subtracting reference voltage Vk from sample-hold voltage Vs. Reference voltage Vk is a voltage obtained by voltage-dividing a forward bias voltage of diode 28 by a voltage-dividing ratio of resistors 30 and 31. Reference voltage Vk is set at a value corresponding to predetermined value fs (see FIG. 3) for a change in resonating frequency of resonating circuit 6 caused by floating of the object to be heated over top plate 9 due to the repulsion force from coil 7. Initial setting voltage Vh output from circuit 26 is supplied to the noninverting input terminal (+) of comparator 32. The inverting terminal (−) of comparator 32 receives detection voltage Vp from F-V converter 21. Therefore, if detection voltage Vp is higher than initial setting voltage Vh, in other words, if a change in voltage (Vs−Vp) corresponding to a change in frequency is below reference voltage Vk corresponding to predetermined value fs, comparator 32 outputs a LOW-level signal. If detection voltage Vp is lower than initial setting voltage Vh, in other words, if a change in voltage (Vs−Vp) corresponding to a change in frequency exceeds reference voltage Vk corresponding to predetermined value fs, comparator 32 outputs HIGH-level error detection signal Se, and supplies it to power control circuit 33. When power control circuit 33 receives signal Se, it turns off switching thyristor 18, thereby stopping the power output of inverter 12.

Figure 3A:
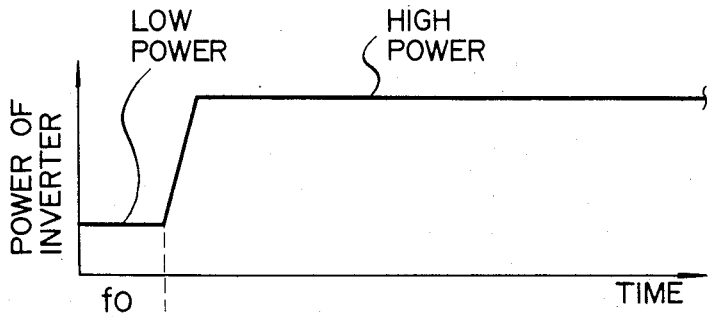
Figure 3B:
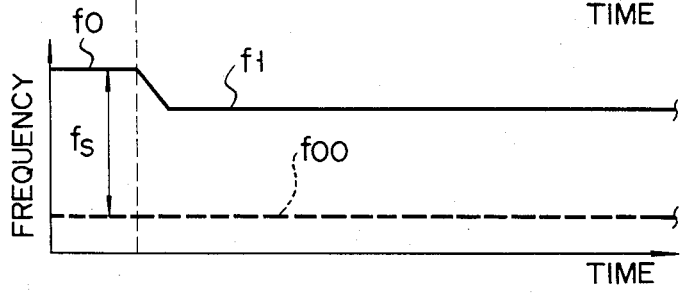

The effect of the above arrangement will now be described. A case will be described with reference to FIGS. 3A and 3B wherein cooking vessel 35 as an object to be heated is formed of iron. FIGS. 3A and 3B show changes in power of inverter 12 and changes in frequency of resonating circuit 6. After vessel 35 as the object to be heated is placed on top plate 9, power variation circuit 19 phase-controls thyristor 18 upon turning on a power switch or a switch for detecting a state of vessel 35 (neither are shown), so as to set inverter 12 in the low-power mode for a predetermined period of time. Thus, resonating circuit 6 is set at resonating frequency f corresponding to vessel 35 ($f=1/(2\pi\cdot\sqrt{LC})$, where L is an inductance of induction coil 7, and C is a capacitance of capacitor 8). At this time, sampling timing signal St from power variation circuit 19 is supplied to analog switch 24 of states determination circuit 20. As a result, sample-hold voltage Vs corresponding to resonating frequency f, i.e., initial voltage f0, of resonating circuit 6 in the low-power mode, is sampled and held by sample-hold circuit 22 of circuit 20. Reference voltage Vk (corresponding to predetermined value fs for a change in frequency) is subtracted from sample-hold voltage Vs, thereby determining initial setting voltage Vh. A frequency corresponding to voltage Vh is indicated by f00 in FIG. 3B. When the power mode of inverter 12 is subsequently changed by power variation circuit 19 from the low-power mode to high-power mode, the repulsion force from coil 7 to vessel 35 increases. If vessel 35 is formed of iron, its weight is large, and vessel 35 consists of a magnetic material. Therefore, an attractive force from coil 7 acting on vessel 35 is increased. As a result, the repulsion force is canceled by the attractive force, and becomes virtually negligable. Vessel 35 thus remains on top plate 9 in a stationary state. In this case, resonating frequency f of resonating circuit 6 is decreased to resonating frequency f1, as shown in FIG. 3B. However, a change in frequency is small. Therefore, change f1 is larger than predetermined value f00, and hence, a change in frequency (f0−f1) is below predetermined value fs. Detection voltage Vp in determination circuit 20 is higher than initial setting voltage Vh. As a result, the output terminal of comparator 32 is kept at LOW level by determination circuit 20. In this state, no error detection signal Se is output.

Figure 3C:
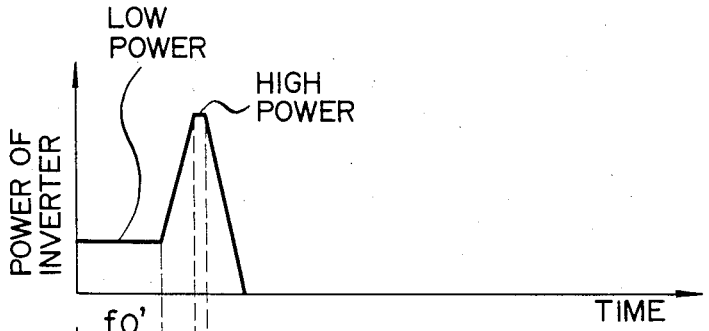
Figure 3D:
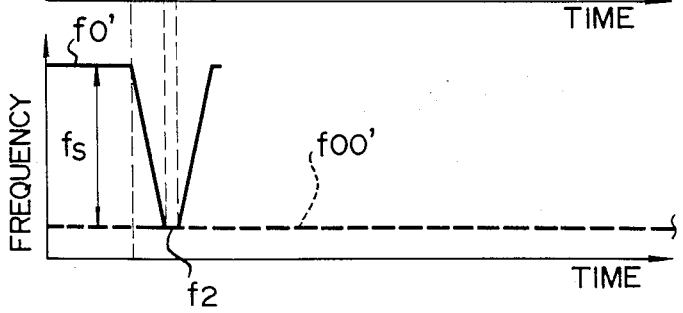

A case will be described with reference to FIGS. 3C and 3D wherein vessel 35 is made of a material which has a relatively small weight such as aluminum and which is a non-magnetic material. In this case, resonating frequency f when inverter 12 is set in the low-power mode by power variation circuit 19 is indicated by f0'. If a sample-hold voltage in this case is given as Vs', an initial setting voltage is voltage Vh' obtained by subtracting reference voltage Vk from voltage Vs'. A frequency corresponding to initial setting voltage Vh' is given as frequency f00'. In this case, if the power mode of inverter 12 is changed from the low-power mode to a high-power mode by power variation circuit 19, the repulsion force from coil 7 increases, as can be seen from FIG. 5 described above. An attractive force from coil 7 to vessel 35 formed of a non-magnetic material, such as Al, becomes small, and vessel 35 may float in accordance with the total weight of vessel 35 and a material to be cooked therein. In this case, however, if vessel 35 floats, a gap between vessel 35 and induction coil 7 is increased, i.e., magnetic flux leakage becomes large, and inductance L of coil 7 is increased. As a result, a change (f0'−f2) in resonating frequency f exceeds predetermined value fs in FIG. 3D (f00'>f2). As a result, detection voltage Vp' in determination circuit 20 becomes smaller than initial setting voltage Vh', and error detection signal Se is output. Thus, it is detected that vessel 35 is in a floating state. Error detection signal Se is supplied to power control circuit 33. Power control circuit 33 forcibly turns off switching thyristor 18, and stops the power output from inverter 12.

Assume that vessel 35 is shifted from an appropriate position on top plate 9 if vessel 35 consists of either iron or Al. In this case, magnetic flux leakage becomes large, and inductance L is also increased. Therefore, an inappropriate placement of vessel 35 can be detected.

According to this embodiment, in order to produce inverter power level control data according to the relationship between the inverter output and the repulsion force acting on vessel 35, power variation circuit 19 for varying the output mode of inverter 12 from the low-power mode to high-power mode is arranged. In addition, states determination circuit 20 is arranged. Determination circuit 20 detects resonating frequency f of resonating circuit 6, and outputs error detection signal Se when a change (f0−f1, f0'−f2) exceeds a predetermined value (fs). With these circuit components, if a degree of change in resonating frequency f of resonating circuit 6 is considerably large upon change in power mode of inverter 12, i.e., a repulsion force to a cooking vessel is large enough to cause it to float, error detection signal Se is generated. As a result, it can be reliably and easily detected whether vessel 35 is in a floating state over top plate 9, or an inappropriate placement of vessel 35 can also be detected. Based on the detection result, the power output of inverter 12 is stopped to prevent the vessel from floating. This apparatus can prevent vessel 35 from being moved along top plate 9, and the induction heating cooker can be prevented from being used in a heat-cooking disabled state. The power level of inverter 12 can be controlled in accordance with weight detection data of a vessel, as in the following embodiment. Thus, reliable heat-cooking can be performed.

Figure 4:
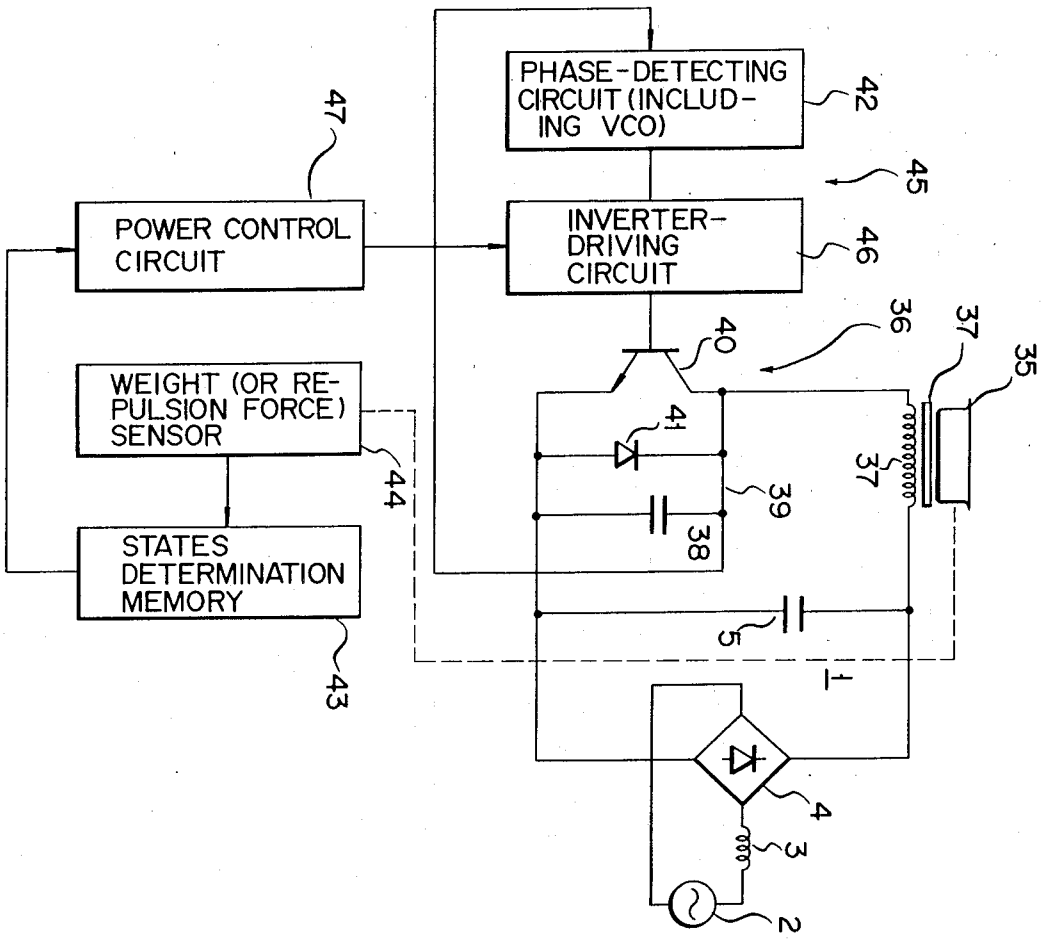
FIG. 4 is a general block diagram showing a second embodiment of the present invention in correspondence with FIG. 1.

FIG. 4 shows a second embodiment of the present invention. The same reference numerals in the second embodiment denote the same parts as in the first embodiment. A difference between the first and second embodiments (FIGS. 1 and 4) will be described below. Reference numeral 36 denotes an inverter which is used instead of inverter 12, and comprises resonating circuit 39 consisting of induction coil 37 and resonating capacitor 38. Instead of first and second switching transistors, one switching transistor 40 and dumper diode 41 are arranged. In the second embodiment, a terminal voltage of resonating capacitor 38 is output to phase detecting circuit 42 without arranging an instrument transformer, and a phase difference is detected based on a change in output voltage. Inverter driving circuit 46, which constitutes inverter control circuit 45 together with phase detecting circuit 42, controls switching transistor 40.

In this embodiment, unlike in the first embodiment, the power mode of the inverter is not changed from the low-power mode to high-power mode for a predetermined period of time so as to detect a change in resonating frequency and to obtain inverter power level control data. More specifically, in this embodiment, the weight of vessel 35 or a repulsion force thereto is detected by sensor 44 for a predetermined period of time. States determination memory 43 prestores inverter power control level data according to the relationship between the inverter power and the repulsion force applied to a cooking vessel, as shown in FIG. 5. Power control circuit 47 controls inverter driving circuit 46 based on inverter power level control data read out from determination memory 43 according to the vessel weight or repulsion force detection data from sensor 44.

According to the second embodiment, inverter power level control data is prestored in memory 43 in accordance with the relationship between the power of inverter 36 and the repulsion force applied to vessel 35. The inverter power level control data is read out from memory 43 in accordance with the weight data of vessel 35 or repulsion force detection data from sensor 44, so as to control the power of inverter 36. Therefore, in this embodiment, the weight of the vessel and the repulsion force applied to the vessel caused by the inverter power at that time are balanced, so that an appropriate inverter power that can prevent the vessel from floating can always be provided.

Figure 6:
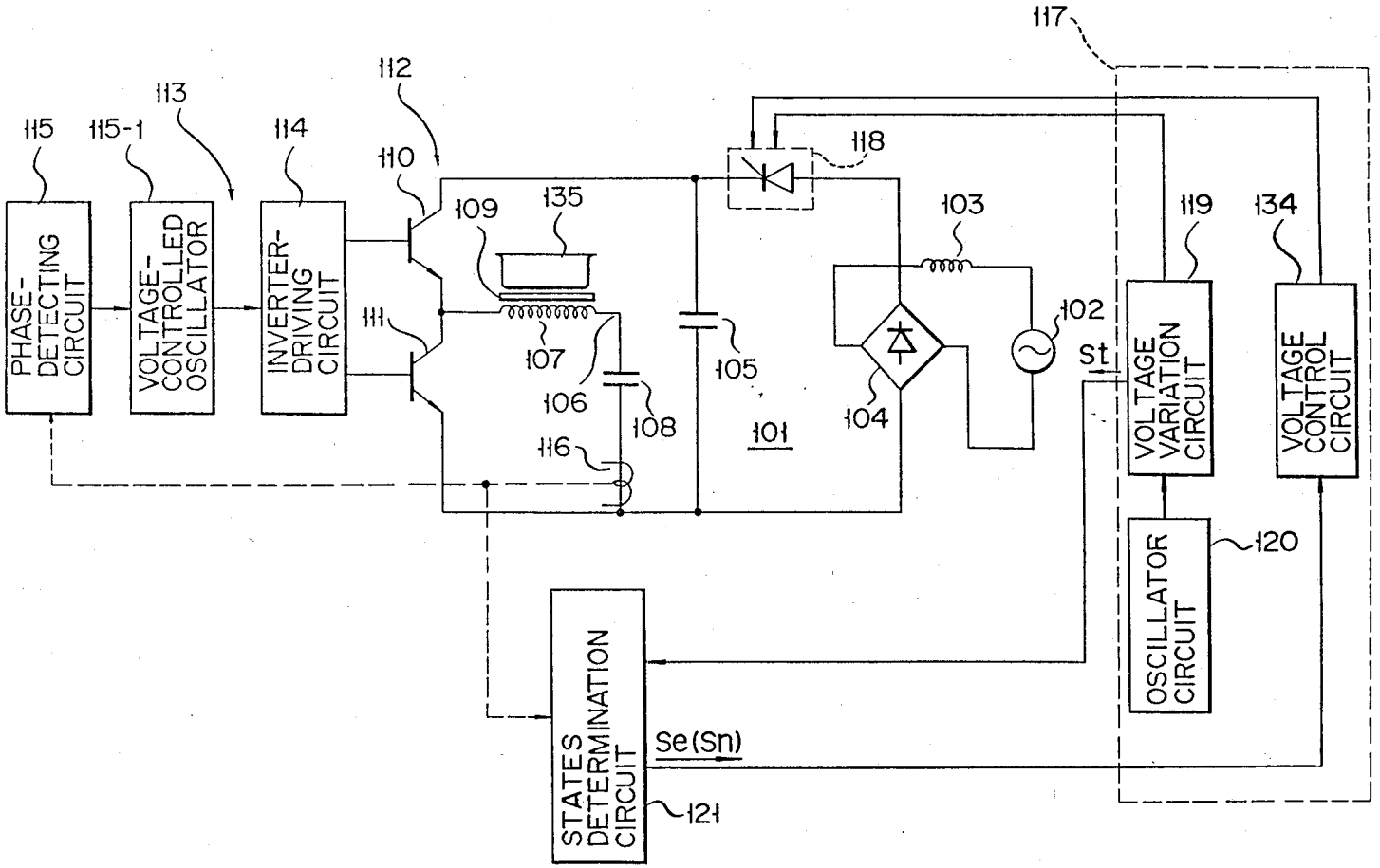

A third embodiment of the present invention will now be described with reference to FIGS. 6 to 8. In FIG. 6, reference numeral 101 denotes a DC power source. DC power source 101 is constituted by connecting choke coil 103, full-wave rectifier 104, and smoothing capacitor 105 to AC power source 102. Reference numeral 106 denotes a resonating circuit consisting of induction coil 107 for heating an object to be heated, and resonating capacitor 108. Induction coil 107 is arranged below the lower surface of top plate 109 for placing the object to be heated thereon. Reference numerals 110 and 111 denote first and second switching transistors. Transistors 110 and 111 are connected to resonating circuit 106, as shown in FIG. 6, to constitute inverter 112. Reference numeral 113 denotes an inverter controller. Controller 113 has inverter driving circuit 114, phase detecting circuit 115, and voltage controlled oscillator (VCO) 115-1. Inverter driving circuit 114 alternately turns on/off switching transistors 110 and 111. Phase detecting circuit 115 receives an output from instrument transformer 116 in resonating circuit 106, so as to feedback control inverter driving circuit 114 through VCO 115-1. More specifically, inverter driving circuit 114 controls the ON/OFF timing of transistors 110 and 111 based on an oscillation output from VCO 115-1 in accordance with the phase comparison output, thereby controlling an output frequency of inverter 112. As a result, resonating circuit 106 is controlled to maintain a frequency (resonance frequency) at which a resonating state is set for the object to be heated. Reference numeral 119 denotes a voltage variation circuit for changing the output voltage, as a power source voltage, of DC power source 101 to be supplied to inverter 112. Voltage variation circuit 119 periodically phase-controls switching thyristor 118, and the gate electrode in accordance with an oscillation signal from oscillator circuit 120. The main electrodes of switching thyristor 118 are connected to DC power source 101, as shown in FIG. 6. Voltage variation circuit 119 periodically functions based on the oscillation signal having predetermined period T1 (see FIGS. 8A to 8D) supplied from oscillator circuit 120. More specifically, voltage variation circuit 119 changes the output period and output duration of a gate signal supplied to switching thyristor 118 during predetermined function time T2 (FIGS. 8A to 8D) for each period T1, thereby changing an ON/-OFF time interval of thyristor 118. Thus, the power source voltage supplied to inverter 112 is changed from low voltage V1 to high voltage V2. Gate signal output circuit 119 outputs HIGH-level sampling timing signal St to states determination circuit 121 which is the same as that in the first embodiment, when voltage variation circuit 117 is set in the low-voltage V1 control mode. Determination circuit 121 periodically or sequentially detects a change in resonating frequency f of resonating circuit 106 based on the output from instrument transformer 116 in order to obtain inverter power level control data, in the same manner as in the first embodiment. Thus, either normal detection signal Sn or error detection signal Se is output.

Figure 7:
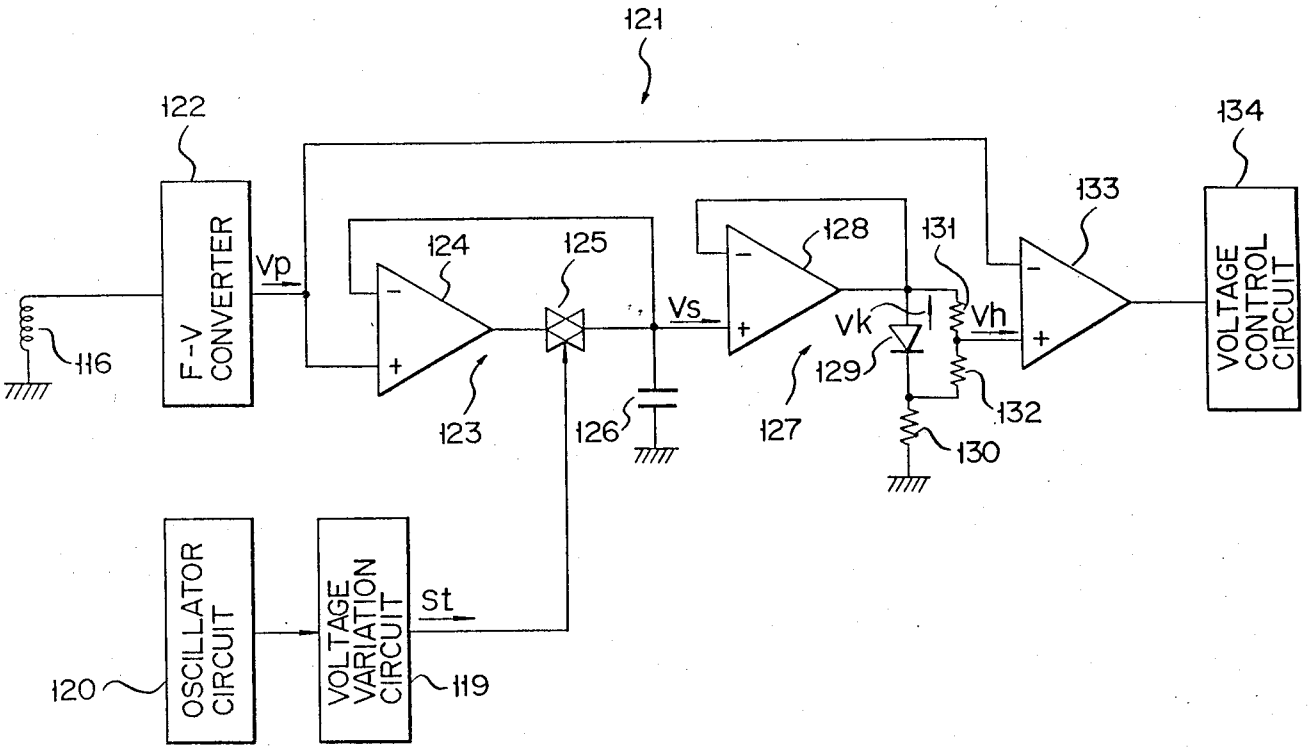

FIG. 7 shows states determination circuit 121 in detail. Reference numeral 122 denotes an F-V converter which detects resonating frequency f of resonating circuit 106 from the output from instrument transformer 116, and converts it into a voltage. F-V converter 122 supplies detection voltage Vp corresponding to the detected frequency to the noninverting input terminal (+) of operational amplifier 124 of sample-hold circuit 123, and supplies it to the inverting terminal (−) of comparator 133 (to be described later). Sample-hold circuit 123 has operational amplifier 124, analog switch 125, and memory capacitor 126. The gate terminal of analog switch 125 receives sampling timing signal St from voltage variation circuit 119 when circuit 119 is set in the low-voltage control mode. Memory capacitor 126 generates output voltage Vp component corresponding to resonating frequency f, i.e., initial frequency f0, of resonating circuit 106 when circuit 119 is in the low-voltage control mode, as sample-hold voltage Vs. Reference numeral 127 denotes a reference value setting circuit. Reference value setting circuit 127 comprises operational amplifier 128, diode 129, and resistors 130, 131, and 132. Reference voltage setting circuit 127 subtracts reference voltage Vk determined by resistors 130 to 132 from sample-hold voltage Vs supplied to the noninverting input terminal (+) of operational amplifier 128, thereby outputting initial setting voltage Vh. Reference voltage Vk is set at a voltage value corresponding to change fs in resonating frequency (FIGS. 8A to 8D) of resonating circuit 106 caused such that an object to be heated floats over top plate 109. Initial setting voltage Vh output from setting circuit 127 is supplied to the noninverting input terminal (+) of comparator 133. The inverting terminal (−) of comparator 133 receives output voltage Vp from F-V converter 122. Therefore, if output voltage Vp is higher than initial setting voltage Vh, comparator 133 outputs LOW-level normal detection signal Sn to voltage control circuit 134. If output voltage Vp is lower than voltage Vh, comparator 133 outputs error detection signal Se to control circuit 134. When voltage control circuit 134 receives normal detection signal Sn, it controls switching thyristor 118 so as to supply high voltage V2 to inverter 112 to set it in the high-power mode. When circuit 134 receives error detection signal Se, it controls thyristor 118 so as to supply low voltage V1 to inverter 112 to set it in the low-power mode.

The effect of the above arrangement will now be described. A case will be described with reference to FIGS. 8A and 8B wherein cooking vessel 135, as an object to be heated, is formed of iron. FIGS. 8A and 8B show changes in the power source voltage of inverter 112 and changes in the frequency of resonating circuit 106 associated therewith. After vessel 135, as the object to be heated, is placed on top plate 109, voltage variation circuit 119 supplies low voltage V1 as the power source voltage to inverter 112 so as to set it in the low-power mode for a predetermined period of time, based on the oscillation signal of predetermined period T1 from oscillator circuit 120. Thus, in inverter 112, resonating frequency f of resonating circuit 106 corresponding to vessel 135 is set ($f=1/(2\pi\cdot\sqrt{LC})$, where L is an inductance of induction coil 107 and C is a capacitance of capacitor 108). At this time, sampling timing signal St from voltage variation circuit 119 is supplied to determination circuit 121. As a result, sample-hold voltage Vs corresponding to resonating frequency f, i.e., initial frequency f0, of resonating circuit 106 is sampled and held by sample-hold circuit 123 of determination circuit 121. Reference voltage Vk (corresponding to change fs in frequency) is subtracted from sample-hold voltage Vs, thereby determining initial setting voltage Vh. A frequency (predetermined value) corresponding to initial setting voltage Vh is given by f00 in FIG. 8B. When the power source voltage supplied to inverter 112 is changed from low voltage V1 to high voltage V2 by voltage variation circuit 119, a repulsion force applied to vessel 135 is increased. However, if vessel 135 is formed of iron, its weight is large and the vessel consists of a magnetic material. Therefore, an attractive force applied to vessel 135 is increased. As a result, the repulsion force is canceled by the attractive force, and is reduced to a negligable level. Therefore, vessel 135 remains on top plate 109 in a stationary state. Al though resonating frequency f of resonating circuit 106 is decreased to frequency f1, as shown in FIG. 8B, change f1 is larger than predetermined value f00. More specifically, in this state, output voltage Vp in determination circuit 121 is higher than initial setting voltage Vh. As a result, the output terminal of comparator 133 is kept at LOW level by determination circuit 121. In this state, normal detection signal Sn is output, and is supplied to voltage control circuit 134. Control circuit 134 controls thyristor 118 so as to supply high voltage V2 to inverter 112, thereby setting it in the high-power mode. In this manner, the power source voltage is optimized. The placement state detection of vessel 135 is periodically performed during cooking based on the oscillation signal from oscillator circuit 120.

If a user sets a material to be cooked into vessel 135 or stirs it therein, vessel 135 may be shifted from an appropriate location. In this case, the magnetic flux leakage is increased, and inductance L of induction coil 107 is increased. As a result, resonating frequency f of resonating circuit 106 is decreased, and an induction heating efficiency may be degraded. Assume that vessel 135 is shifted at time T3 in FIGS. 8A and 8B in this manner. After time T3, since voltage variation circuit 119 functions periodically, a power source voltage for inverter 112 is decreased to low voltage V1 thereby, and then, low voltage V1 is changed to high voltage V2. Upon this change in voltage, when resonating frequency f of resonating circuit 106 is decreased to f2 below frequency f00 as a predetermined value, as shown in FIG. 8B, output voltage Vp corresponding to resonating frequency f2 becomes smaller than initial setting voltage Vh corresponding to frequency f00 in determination circuit 121. Therefore, error detection signal Se is output. In this manner, it is detected that vessel 135 is shifted from an appropriate position. Error detection signal Se is supplied to voltage control circuit 134. Control circuit 134 controls switching thyristor 118 so as to supply low voltage V1 as the power source voltage supplied to inverter 112, thereby setting inverter 112 in the low-power mode. In this manner, the power source voltage is optimized, and resonating frequency f is increased, thus obtaining a sufficient heating efficiency. Note that if vessel 135 is initially shifted from an appropriate position, this is similarly detected, and a power source voltage is controlled.

A case will be described with reference to FIGS. 8C and 8D wherein vessel 135 consists of an Al material, and has small weight and specific permeability. In this case, resonating frequency f when the power source voltage applied to inverter 112 is low voltage V1 is indicated by f0', and a frequency (predetermined value) corresponding to initial setting voltage Vh is given as frequency f00'. In this case, if the power source voltage is changed from low voltage V1 to high voltage V2, the repulsion force applied to vessel 135 is increased, as can be seen from FIG. 5 described above. Since the attractive force to vessel 135 is decreased, vessel 135 may float, in accordance with the total weight of vessel 135 and its content. In this case, a gap between vessel 135 and induction coil 107 is increased by floating, and hence, a magnetic flux leakage is increased. Therefore, inductance L of induction coil 107 is increased. As a result, resonating frequency f of resonating circuit 106 is considerably decreased to resonating frequency f2 in FIG. 8B (below frequency f00' as a predetermined value), and detection voltage Vp in determination circuit 121 becomes smaller than setting voltage Vh. Thus, error detection signal Se is output. In this manner, it is detected that vessel 135 is in the floating state. Error detection signal Se is supplied to voltage control circuit 134. Based on this signal, control circuit 134 controls switching thyristor 118 so as to set the power source voltage supplied to inverter 112 at low voltage V1. Thus, the power source voltage applied to inverter 112 is optimized. In this manner, vessel 135 can be prevented from floating and resonating frequency f is increased, thereby obtaining a sufficient heating efficiency.

Figures 8A, 8B, 8C, 8D:
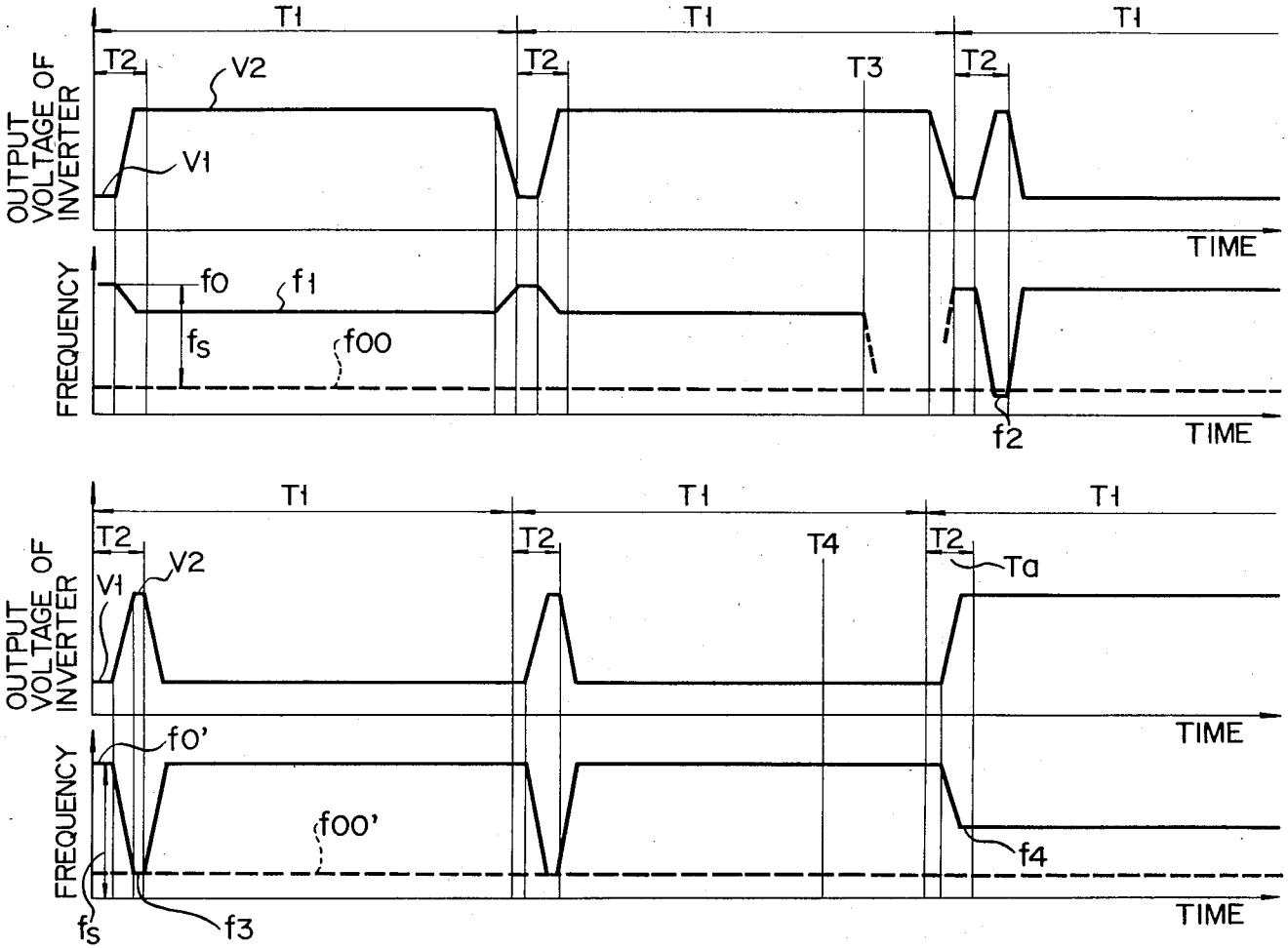

Assume that the total weight of vessel 135 is increased such that a new material to be heated is set in vessel 135, at time T4 in FIGS. 8C and 8D. In other words, assume that vessel 135 is not floating, even if the power source voltage supplied to inverter 112 is changed to high voltage V2 in order to set inverter 112 in the high-power mode. In this case, when voltage variation circuit 119 functions after time T4, the placement state of vessel 135 can be detected. More specifically, when the power source voltage is changed to high voltage V2 after it is decreased to low voltage V1, resonating frequency f of resonating circuit 106 is decreased to frequency f4, as shown in FIG. 8D. Resonating frequency f4 detected at that time is higher than predetermined frequency f00'. As a result, determination circuit 121 outputs normal detection signal Sn, and supplies it to voltage control circuit 134. Control circuit 134 controls switching thyristor 118 so as to supply high voltage V2 as the power source voltage to inverter 112, thereby setting inverter 112 in the high-power mode. Thus, the power source voltage is optimized in accordance with the state of vessel 135.

According to this embodiment, inverter controller 113 is arranged to feedback control the output frequency of inverter 112 so that resonating circuit 106 is set in the resonating state with respect to vessel 135, in order to obtain inverter power level control data, in the same manner as in the first embodiment. Thus, even if the placement state of vessel 135 is changed, resonating circuit 106 is controlled to be normally resonated. Voltage variation circuit 119 is arranged to change the power source voltage from low voltage V1 to high voltage V2 so as to periodically set inverter 112 from the low-power mode to the high-power mode. Furthermore, states determination circuit 121 is arranged to detect resonating frequency f of resonating circuit 106 upon change in voltage. If a change from an initial frequency in the case of low voltage V1 exceeds a predetermined value, determination circuit 121 outputs normal detection signal Sn; otherwise, outputs error detection signal Se. Thus, since the apparatus of this embodiment outputs either normal detection signal Sn or error detection signal Se, it can be reliably and easily detected whether vessel 135 is floating over top plate 109 or is placed in an appropriate position. Since voltage variation circuit 119 is periodically operated so as to periodically perform the above detection, the power source voltage applied to inverter 112 is controlled in accordance with the detection result so as to control the power level of inverter 112. If vessel 135 is floating, in accordance with its material or its weight, an appropriate power source voltage that can prevent vessel 135 from floating can be supplied to inverter 112. If vessel 135 is shifted from the appropriate position on top plate 109, an appropriate power source voltage (low voltage V1) can be supplied to inverter 112 to increase resonating frequency f. Therefore, stable cooking can always be performed.

Figure 9:
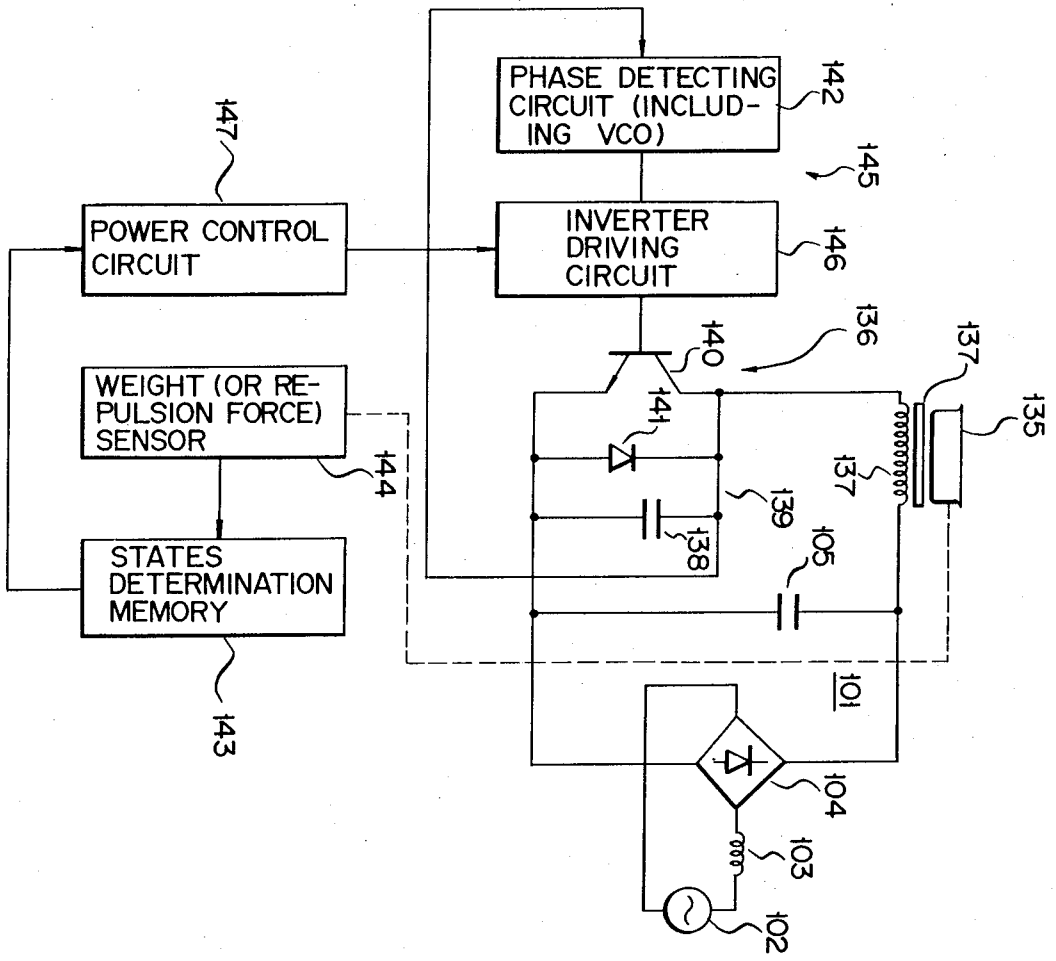
FIG. 9 is a general block diagram showing a fourth embodiment of the present invention in correspondence with FIG. 6.

FIG. 9 shows a fourth embodiment of the present invention, and the same reference numerals in FIG. 9 denote the same parts as in the third embodiment. Only the difference from FIG. 6 will be described below. Reference numeral 136 denotes an inverter which is used instead of inverter 112, and comprises resonating circuit 139 consisting of induction coil 137 and resonating capacitor 138. One switching transistor 140 and dumper diode 141 are arranged instead of first and second switching transistors 110 and 111. In the fourth embodiment, a terminal voltage of capacitor 138 is output to phase detecting circuit 142 without using an instrument transformer. Based on a change in output voltage, a phase difference is detected. Voltage variation circuit 144 includes an oscillator circuit for periodic operation. Inverter driving circuit 146 constitutes feedback control circuit 145 together with phase-detecting circuit 142, including a voltage-controlled oscillator (VCO). Driving circuit 146 controls switching transistor 140. Voltage control circuit 147 controls inverter driving circuit 146 based on the inverter power level control data corresponding to the weight of vessel 135 or the repulsion force, read out from determination memory 143, in accordance with periodical vessel weight or repulsion force detection data from sensor 144. The fourth embodiment can provide the same effect as in the second embodiment.

According to the present invention as described above, an object to be heated can be reliably and easily prevented from floating over the top plate.

In this embodiment, unlike in the third embodiment, the power mode of the inverter is not periodically changed from the low-power mode to the high-power mode so as to detect a change in resonating frequency, in order to obtain inverter power level control data. More specifically, in this embodiment, the weight of vessel 135 or a repulsion force applied thereto is periodically detected by sensor 144. States determination memory 143 prestores inverter power control level data according to the relationship between the inverter power and the repulsion force applied to a cooking vessel, as shown in FIG. 5. Voltage control circuit 147 controls inverter driving circuit 146 based on inverter power level control data corresponding to the weight of vessel 135 or the repulsion force, read out from memory 143, in accordance with periodic vessel weight data or repulsion force detection data from sensor 144. In the fourth embodiment, the same effect as in the second embodiment can be provided.

According to the present invention as described above, an object to be heated can be reliably and easily prevented floating over the top plate.

The present invention is not limited to the above embodiments, and can be modified as follows. In the first and third embodiments, instead of switching thyristors 18 and 118, a plurality of diodes of full-wave rectifiers 4 and 104 can be replaced with switching thyristors. The power variation circuit and the voltage variation circuit can change power and voltage, respectively, in accordance with a change in resistance. The states determination circuit can detect the resonating frequency of the resonating circuit based on the output frequency of the VCO of the inverter control circuit. In this case, F-V converters 21 and 122 can be omitted from determination circuits 20 and 121 in the first and third embodiments. The determination circuit can detect the resonating frequency by the number of pulses such that the frequency is pulse-converted. A change in power and a change in voltage in the power variation circuit and the voltage variation circuit can be stepwise. In addition, the control power and the control voltage in the power control circuit and the voltage control circuit can be changed to various levels.

In the first and third embodiments, power variation circuit 19 and output control circuit 33, and voltage variation circuit 119, voltage control circuit 134, and oscillator circuit 120 can be replaced with microprocessors (CPUs) 17 and 117, respectively.

Various other changes and modifications may be made within the spirit and scope of the invention.

What is claimed is:

1. An electromagnetic induction heating apparatus capable of preventing undesirable states of cooking utensils or vessels, said apparatus comprising:

a top plate for placing an object to be heated such as a cooking utensil or vessel thereon;

inverter means having a resonating circuit comprising an induction heating coil arranged below said top plate and a resonating capacitor connected to said coil, and an inverter circuit for supplying high-frequency power to said resonating circuit in order to generate a high-frequency magnetic field from said induction heating coil and to induce an eddy current in said object to be heated;

inverter power level control data generating means for outputting inverter power level control data according to a variation of the repulsion force acting on said object as a function of the high-frequency power from said inverter circuit, the inverter power level control data being data for controlling the level of the high-frequency power from said inverter circuit so as to prevent said object to be heated from floating over a placing surface of said top plate due to the repulsion force; and control means for feeding back the inverter power level control data from said control data generating means to said inverter circuit;

wherein said inverter power level control data generating means comprises:

power variation means, connected to said inverter means, for changing the high-frequency power from low power to high power during a predetermined operation period;

resonating frequency detecting means, connected to said resonating circuit, for separately detecting a resonating frequency of said resonating circuit in a low-power mode and a high-power mode; and determination means for receiving detection outputs of the resonating frequency in the low-power mode and the high-power mode detected by said resonating frequency detection means and comparing a difference between the detection outputs with a predetermined reference value when said object to be heated is floated from the placing surface of said top plate by the repulsion force, thereby outputting the inverter power level control data in accordance with the comparison result.

2. An apparatus according to claim 1, wherein said determination means includes conversion means for converting frequency data as the detection output from said resonating frequency detection means into voltage data.

3. An apparatus according to claim 1, wherein said determination means includes sample-hold means for sampling and holding the detection output from said resonating frequency detection means at a timing synchronous with the operation period of said power variation means.

4. An apparatus according to claim 1, wherein said inverter circuit includes a switching element, an output terminal of which is connected to said resonating circuit, a DC power source connected to an input terminal of said switching element, and an inverter control circuit connected to a control terminal of said switching element.

5. An apparatus according to claim 4, wherein said power variation means controls a DC output voltage of said DC power source.

6. An apparatus according to claim 4, wherein said inverter control circuit includes a phase-detecting circuit for comparing a detection output from said resonating frequency detection means with a reference phase, a voltage-controlled oscillator for receiving an output from said phase-detecting circuit and outputting an oscillation signal of a predetermined period, and an inverter-driving circuit for receiving an output from said voltage-controlled oscillator and supplying a driving output to said control terminal of said switching element.

7. An apparatus according to claim 1, wherein the operation period of said power variation means is set when a power source is turned on.

8. An apparatus according to claim 1, wherein the operation period of said power variation means is repetitively set for a predetermined period.

9. An electromagnetic induction heating apparatus capable of preventing undesirable states of cooking utensils or vessels, said apparatus comprising:

a top plate for placing an object to be heated such as a cooking utensil or vessel thereon;

inverter means having a resonating circuit comprising an induction heating coil arranged below said top plate and a resonating capacitor connected to said coil, and an inverter circuit for supplying high-frequency power to said resonating circuit in order to generate a high-frequency magnetic field from said induction heating coil and to induce an eddy current in said object to be heated;

inverter power level control data generating means for outputting inverter power level control data according to a variation of the repulsion force acting on said object as a function of the high-frequency power from said inverter circuit, the inverter power level control data being data for controlling the level of the high-frequency power from said inverter circuit so as to prevent said object to be heated from floating over a placing surface of said top plate due to the repulsion force; and control means for feeding back the inverter power level control data from said control data generating means to said inverter circuit;

wherein said inverter power level control data generating means includes:

memory means for prestoring the inverter power level data according to the relationship between the high-frequency power from said inverter circuit and the repulsion force acting on said object to be heated based on the high-frequency power;

sensor means for detecting a weight of said object to be heated; and means for reading out the inverter output level data corresponding to the detection output from said sensor means from said memory means.

* * * * *